United States Patent [19]

Isenberg et al.

[11] Patent Number: 4,488,711

[45] Date of Patent: Dec. 18, 1984

[54] TREATING LADLE FOR DUCTILE IRON TREATMENT

[75] Inventors: Gerry E. Isenberg, Cassville; Terry L. Forshey, Calvin; Robert D. Keller, Jr., Belleville, all of Pa.

[73] Assignee: Sperry Corporation, New Holland, Pa.

[21] Appl. No.: 478,393

[22] Filed: Mar. 24, 1983

[51] Int. Cl.[3] ..... C21B 3/00

[52] U.S. Cl. ..... 266/276; 266/275; 222/604

[58] Field of Search ..... 266/275, 236, 240, 276, 266/277, 278, 281, 283; 222/591, 604, 605; 432/263, 264; 248/313, 316 C; 292/256.67

[56] References Cited

U.S. PATENT DOCUMENTS

| | | | |
|---|---|---|---|
| 131,868 | 10/1872 | Fisher | 266/275 |
| 1,006,519 | 10/1911 | Astrom | 266/275 |
| 1,089,139 | 3/1914 | Lummis | 266/240 |
| 1,492,443 | 4/1924 | Francis | 248/313 |
| 1,870,220 | 8/1932 | Astrom | 222/604 |
| 2,341,888 | 2/1944 | White | 248/313 |
| 2,678,268 | 5/1954 | Zifferer | 420/429 |
| 2,852,295 | 9/1958 | Jasper | 292/256.67 |
| 3,764,125 | 10/1973 | Horn et al. | 266/275 |
| 4,131,265 | 12/1978 | McCray | 266/275 |
| 4,149,705 | 4/1979 | Caudill | 266/275 |

*Primary Examiner*—L. Dewayne Rutledge
*Assistant Examiner*—Robert L. McDowell
*Attorney, Agent, or Firm*—Larry W. Miller; Frank A. Seemar; Darrell F. Marquette

[57] ABSTRACT

A treating ladle for use in a foundry in the production of ductile iron is disclosed wherein the treating ladle has a removable bottom portion and a detachably connected ladle carrier. The ladle carrier includes a bail carrier adapted for connection to a hoist and a retaining ring pivotally connected to the bail carrier to support the treating ladle for a tipping motion for emptying the contents thereof. Corresponding tabs mounted on the bottom portion and the body of the treating ladle permit the individual pieces to be bolted together to facilitate a disassembly of the treating ladle when maintenance and/or repair is desired. The treating ladle is adapted for connection to a separately attachable tundish cover.

14 Claims, 3 Drawing Figures

TREATING LADLE FOR DUCTILE IRON TREATMENT

BACKGROUND OF THE INVENTION

The present invention relates generally to foundry equipment and, more particularly, an improved treating ladle for use in the production of ductile iron by the treating of molten base iron with a treatment alloy.

The production of ductile iron generally involves the treatment of a low sulfur base iron with a magnesium alloy within a treating ladle, usually resulting in a production of a certain amount of slag. The bottom of a treating ladle includes a pocket in which the magnesium alloy is deposited before being covered with molten iron for treatment therewith. This pocket is subject to wear of the refractory lining and to a slag build-up which occasionally needs to be removed to maintain the integrity of the pocket.

In the past, the use of an open treating ladle resulted in the generation of a flare and exhaust fumes to the extent that the installation of exhaust hoods have been necessary to meet environmental standards. The development of a tundish cover by R. D. Forrest and H. Wolfensberger for placement over the top of an open treating ladle resulted in significant reductions of both flare and exhaust fumes. However, the Forrest and Wolfensberger tundish cover design requires a manual placement of the cover on the ladle before treatment of the iron and a removal of the cover after treatment to provide for the removal of slag and dross, as well as the addition of magnesium alloy for the subsequent treatment. Accordingly, the weight of the tundish cover was necessarily limited, preventing the use of sufficient refractory in the tundish cover and resulting in frequent failures of the tundish box.

Additional difficulties were encountered with the maintenance and repair of the bottom of the treating ladle, particularly in and around the pocket formed therein. Because of the depth of the treating ladle required to hold approximately 1400 pounds of molten base iron, it is difficult to reach the bottom of the pocket to remove any slag build-up therefrom. In addition, the greatest amount of lining erosion occurs around the pocket curve, resulting in the need to patch this region on a regular basis.

SUMMARY OF THE INVENTION

It is an object of this invention to overcome the aforementioned disadvantages of the prior art by providing a treating ladle having a removable bottom portion.

It is another object of this invention to provide a removable bottom detachably connected to the body portion of the treating ladle.

It is still another object of this invention to improve the serviceability of a treating ladle.

It is an advantage of this invention that the pocket in the bottom of a treating ladle can be serviced, repaired, or replaced without disturbing the body portion of the treating ladle.

It is another advantage of this invention that the refractory lining at the bottom of the treating ladle can be repaired or replaced without the need to rebuild the entire lining of the treating ladle.

It is yet another object of this invention to seal the connection between both the tundish cover and the detachable bottom with the body portion by using a refractory paste.

It is a further object of this invention to provide a ladle carrier for pivotally supporting the treating ladle in mid-air that is detachable from the treating ladle.

It is a feature of this invention that the treating ladle can be disengaged from the ladle carrier to improve serviceability.

It is still a further object of this invention to provide a ladle carrier with a two-piece retaining ring that can be disconnected for removal from the treating ladle.

It is still a further object of this invention to provide stops affixed to the body portion of the treating ladle above and below the retaining ring to restrict the movement of the treating ladle relative to the retaining ring.

It is yet a further object of this invention to provide a treating ladle for use in the production of ductile iron which is durable in construction, inexpensive of manufacture, carefree of maintenance, facile in assemblage and simple and effective in use.

These and other objects, features and advantages are accomplished according to the instant invention by providing a treating ladle for use in a foundry in the production of ductile iron wherein the treating ladle has a removable bottom portion and a detachably connected ladle carrier. The ladle carrier includes a bail carrier adapted for connection to a hoist and a retaining ring pivotally connected to the bail carrier to support the treating ladle for a tipping motion for emptying the contents thereof. Corresponding tabs mounted on the bottom portion and the body of the treating ladle permit the individual pieces to be bolted together to facilitate a disassembly of the treating ladle when maintenance and/or repair is desired. The treating ladle is adapted for connection to a separately attachable tundish cover.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
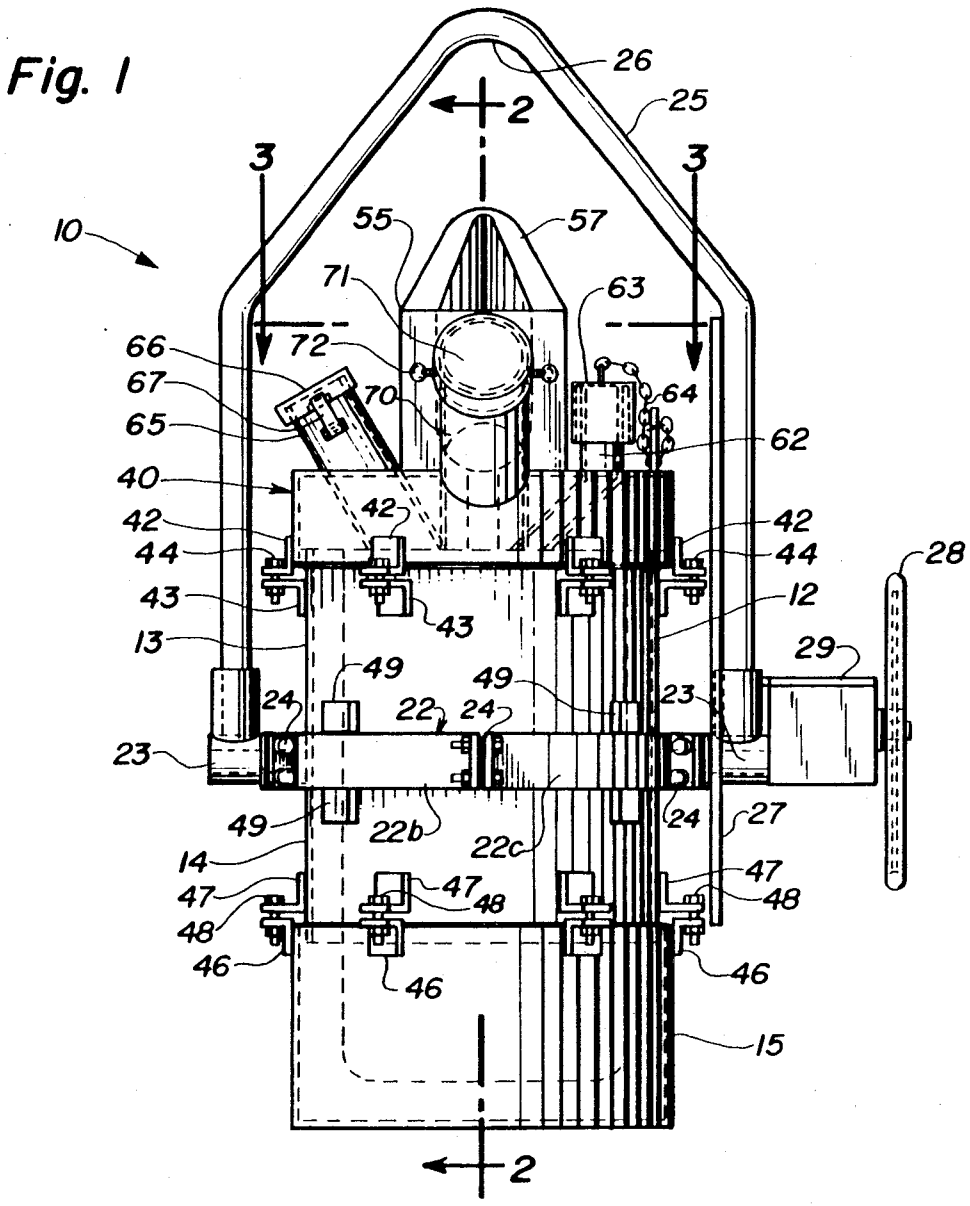
FIG. 1 is a rear elevational view of a three piece treating ladle, incorporating the principles of the instant invention.

Referring now to the drawings and, particularly, to FIG. 1, a rear elevational view of a three piece treating ladle used in the production of ductile iron can be seen. Any references to a forward or rearward direction are defined by the direction of pouring from the ladle, with the spout pointing forwardly. The treating ladle 10 includes a body member 12 having an upper portion 13 and a lower portion 14, a removable bottom member 15 detachably connected to the lower portion 14 of the body member 12, and a tundish cover 40 detachably connected to the upper portion 13 of the body member 12. The joints between the body member 12 and both the tundish cover 40 and the bottom member 15 are sealed with a refractory paste to prevent exhaust gases from leaking therethrough.

To support the treating ladle 10 off the ground and to positionally control the attitude of the treating ladle 10, a conventional hoist mechanism 20 is provided. The ladle carrier 20 includes a retaining ring 22 extending around a medial portion of the body member 12 and having a pair of opposing lugs 23 extending outwardly therefrom. An inverted V-shaped bail carrier 25 pivotally supports the lugs 23 of the strap assembly 22 to provide the capability of tipping the treating ladle 10, as is well known in the art. The apex 26 of the bail carrier 25 is connectable to an overhead crane to mobilely support the treating ladle 10 in mid-air above the ground. A plate 27 is provided to somewhat screen the operator from the ladle 10. Manipulation of the wheel 28 controls, through the gearbox 29, the attitude of the treating ladle 10 relative to the bail carrier 25 to effect a tipping of the treating ladle 10.

The retaining ring 22 is formed into three pieces, a substantially semi-circular front portion **22*a* and two accuate rear portions 22*b*, 22*c*, that are bolted together by connecting bolts 24. To remove the detachable ladle carrier 20, the two rear portions 22*b*, 22*c* are disconnected from the front portion 22*a* so that the entire assembly can be pulled away from the ladle 10. One skilled in the art will readily realize that the retaining ring 22 could be formed by two generally semi-circular members with both pivot lugs 23 on one of the members to facilitate disassembly of the ladle carrier 20**.

Figure 2:
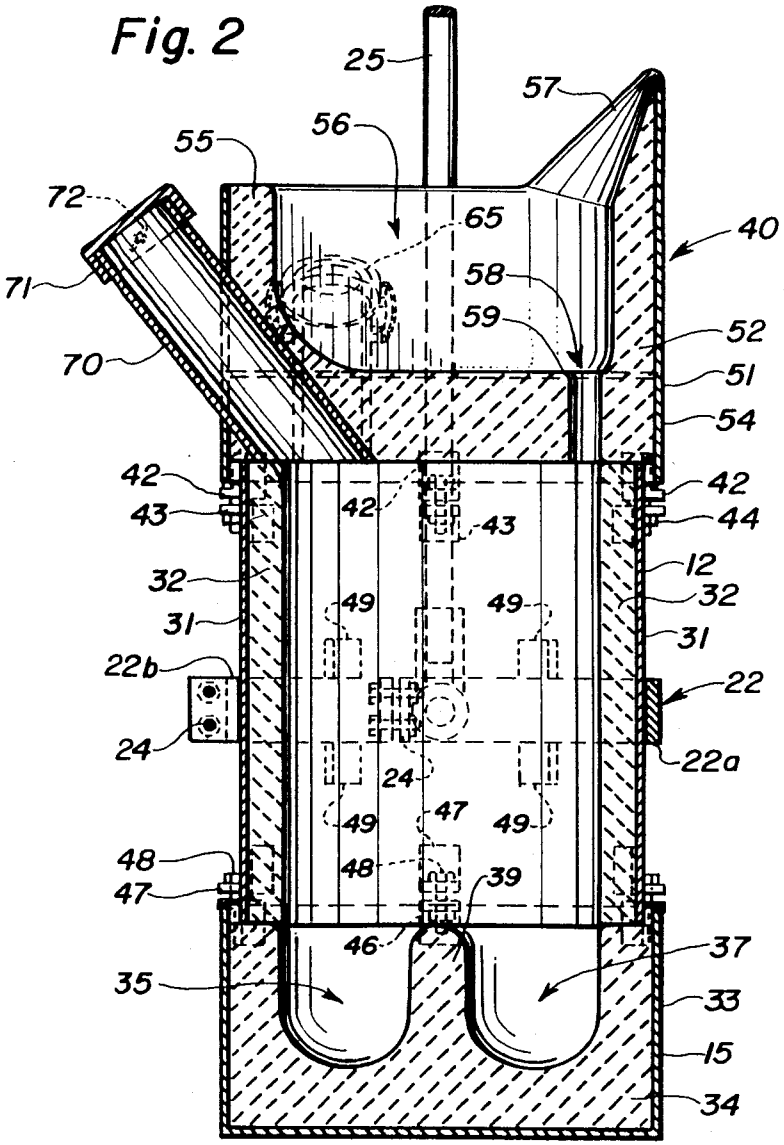
FIG. 2 is a partial cross-sectional view of the treating ladle seen in FIG. 1 taken along lines 2—2.
Figure 3:
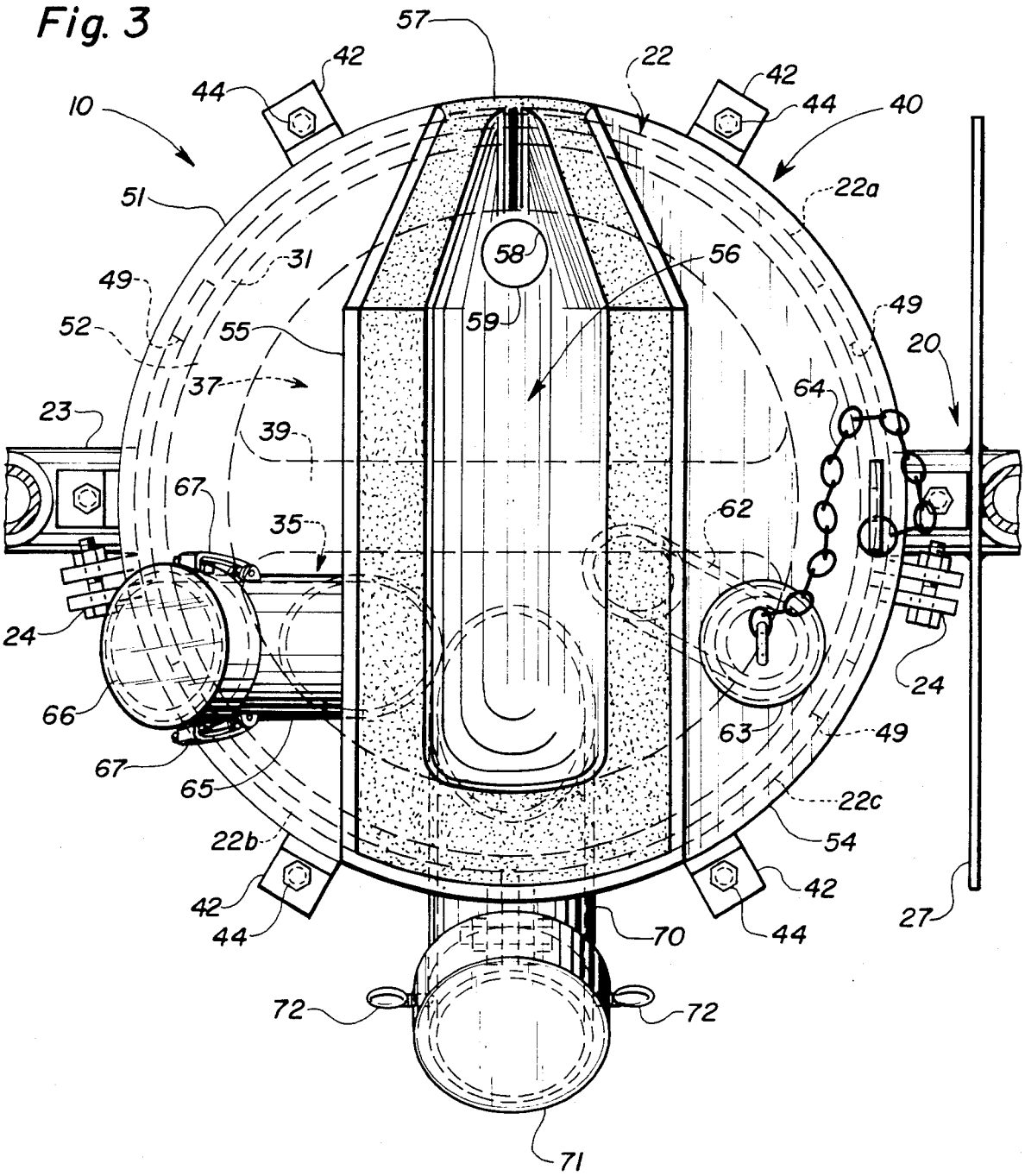
FIG. 3 is a partial cross-sectional view of the treating ladle seen in FIG. 1 taken along lines 3—3, the pockets in the bottom portion of the treating ladle being shown in phantom.

The main body member 12 of the treating ladle 10 is comprised of an outer shell 31 made of a durable material, such as steel, and an inner refractory lining 32 to insulate the treating ladle 10 and retain the heat of the molten iron therein. As can be seen in FIGS. 2 and 3, the body member 12 includes an opening extending generally vertically therethrough from the upper portion 13 to the lower portion 14 to form a hollow tube-like receptacle. The bottom member 15 is also comprised of a steel-like outer shell 33 and an inner refractory lining 34 formed into a first semi-circular pocket 35 and a second semi-circular pocket 37 with a refractory dam 39 extending therebetween. As is best seen in FIG. 2, the first and second pockets 35,37 are formed entirely within the bottom member 15.

The tundish cover 40 includes a plurality of connecting tabs 42 affixed thereto and spaced around the perimeter thereof. The upper portion 13 of the body member 12 has an equal member of corresponding tabs 43 extending around the circumference thereof in positions that are alignable with the connecting tabs 42. Bolts 44 fastening corresponding connecting tabs 42,43 detachably affix the tundish cover 40 to the upper portion 13 of the body member 12. Similarly, the bottom member 15 includes a plurality of connecting tabs 46 spaced around the perimeter thereof, while the bottom portion 14 of the body member 12 has corresponding connecting tabs 47 spaced around the perimeter thereof for alignment with the connecting tabs 46. Bolts 48 interengaging corresponding tabs 46,47 detachably affix the bottom member 15 to the lower portion 14 of the body member 12. The body member 12 also includes a plurality of stops 49 spaced around the medial portion thereof adjacent the strap assembly 22 to prevent the treating ladle from sliding through the strap assembly 22 when the hoist mechanism 20 lifts the ladle 10 off the ground.

The tundish cover 40 is comprised of an outer shell 51 and an inner refractory lining 52 formed into a substantially closed lid portion 54. Mounted on top of the lid portion 54 is a substantially rectangular tundish box 55 forming a hollow, open-topped basin receptacle 56. The tundish box 55 is formed with a spout 57 to facilitate the pouring of molten iron from the treating ladle 10. A basin orifice 58 extends downwardly through the tundish cover 40 into the opening through the main body member 12 to form a passageway interconnecting the tundish box 55 and the interior of the treating ladle 10.

The size of the basin orifice 58 is critical in that it controls the filling rate of the treating ladle 10. If the diameter of the basin orifice 58 is not maintained, variations in treatment time will occur. Difficulties in maintaining the size of the diameter of the basin orifice 58 have been reduced by the use of a ceramic sleeve 59 within the orifice 58. The basin orifice 58 is used both to let molten base iron into the treating ladle 10 and to tap out treated iron from the ladle 10.

The tundish cover 40 also includes a pressure-exhaust port 62 set equal in height to the level of the molten base metal within the tundish box 55 during treatment. A loose, floating cover 63 over the exhaust port 62 provides a host for oxide condensation during the treatment process. The cover 63 is connected to the tundish cover 40 by means of a chain 64. The tundish cover 40 is also provided with a charging tube 65 having a cover 66 removably affixed thereto by means such as overcenter clamps 67 or threading (not shown). The charging tube 65 is positioned so that a treatment alloy can be introduced into the first pocket 35 of the treating ladle without removing the tundish cover 40 from the body member 12. The secured cover 66 enables a tight seal to be obtained with respect to the charging tube 65 to prevent the build-up of oxides within the charging tube.

The tundish cover 40 is further provided with a slag removal port 70 having a cover 71 secured thereto by means such as set screws 72. The slag removal port 70 is positioned to be diametrically opposed to the basin orifice 58 to facilitate a removal of slag from within the treating ladle 10. The slag removal port 70 permits slag and/or dross to be pulled out of the treating ladle 10 as necessary between treatments without requiring the tundish cover 40 to be removed from the body member 12 and reduces the probability of slag and/or dross plugging the basin orifice 58, as well as reduces the amount of slag and/or dross transferred out of the treating ladle 10 with the treated iron.

Ductile iron can be produced by use of the treating ladle 10 by introducing a magnesium alloy into the charging tube 65 for deposit within the first pocket 35. With all three pieces 12, 15 and 40 of the treating ladle 10 in place, molten base iron is tapped into the basin of the tundish box 55, resulting in the delivery of the molten base iron to the treating ladle 10 at a controlled rate determined by the geometry of the basin orifice 58. The molten basin iron first flows through the basin orifice 58 into the second pocket 37 and is prevented from reacting with the magnesium in the first pocket 35 because of the presence of the refractory dam 39. After sufficient molten iron has been introduced into the treating ladle 10 to fill the second pocket 37, the molten iron spills over the refractory dam 39 into the first pocket 35 and reacts with the magnesium alloy therein. The exhaust gases and flare accompanying the magnesium/molten iron reaction is substantially controlled by the tundish cover 40. Exhaust gases are emitted from the exhaust port 62 during the treatment, but a large percentage of the magnesium vapor therein oxidizes and condenses on the inner walls of the exhaust port cover 63, which can be easily cleaned between treatments.

When it is desirable to service or repair one or more of the pockets 35,37 in the bottom member 15, the bolts 48 can be loosened and the bottom member 15 removed from the body member 12 to permit an easy repair thereof without being encumbered by the presence of the body member 12. Furthermore, the entire refractory lining 34 of the bottom member 15 can be removed and replaced without disturbing the refractory lining 32 of the body member 12. The use of the tundish cover 40 results in a reduction of the temperature loss during the treatment of the molten base iron. This has enabled an appropriate reduction in the melting furnace tap temperature, resulting in accompanying benefits in melt rate and lining life. As one skilled in the art will ready realize, the three piece treating ladle 10 has resulted in improved serviceability and significant cost savings in both materials and labor.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A treating ladle for use in a foundry in the production of ductile iron by the treating of molten base iron with a treatment alloy, comprising:

a body member including a generally vertical outer shell, said body member having an upper portion, a lower portion below said upper portion and an opening therethrough extending from said upper portion to said lower portion;

a bottom member including an outer shell having a generally horizontal floor portion and a generally vertically extending side portion integral with said floor portion;

fastening means for detachably connecting said bottom member to said lower portion of said body member, said fastening means including a first set of connecting tabs affixed to said lower portion of said body member in a spaced relationship around the perimeter of said body member, a second set of connecting tabs affixed to said side portion of said bottom member in spaced relationship around the perimeter of said bottom member, each connecting tab of said first set being alignable with a corresponding connecting tab of said second set, and a fastener for connecting each corresponding pair of connecting tabs to detachably connect said bottom member to said body member; and a first refractory lining affixed to said body member shell and a second refractory lining affixed to said bottom member shell, said second refractory lining forming a pair of semi-circular pockets with a refractory dam extending therebetween, the joint between said bottom member and said body member being sealed with a refractory paste.

2. The treating ladle of claim 1 wherein said side portion of said bottom member extends vertically from said floor portion a distance at least as high as said pocket, said bottom member completely encompassing said pocket.

3. The treating ladle of claim 2 further comprising a ladle carrier for supporting said treating ladle above the ground, said ladle carrier including a bail carrier adapted for connection to an overhead hoist and a retaining ring pivotally connected to said bail carrier and engaged with said treating ladle, the pivotal connection between said retaining ring and said bail carrier permitting a tipping of said treating ladle relative to said bail carrier.

4. The treating ladle of claim 3 wherein said ladle carrier is disengageable from said treating ladle.

5. The treating ladle of claim 4 wherein said body member has a plurality of stops affixed thereto, said retaining ring being engageable with said stops to support said treating ladle above the ground.

6. The treating ladle of claim 5 wherein said retaining ring includes first and second semi-circular members and connecting means for detachably connecting said first and second members to form a generally circular retaining ring.

7. The treating ladle of claim 6 wherein said body member includes stops positioned above said retaining ring and below said retaining ring to prevent said body member from moving relative to said retaining ring.

8. A treating ladle for use in a foundry in the production of ductile iron by the treating of molten base iron with a treatment alloy, comprising:

a body member including a generally vertical outer shell having a refractory lining affixed thereto, said body member having an upper portion, a lower portion below said upper portion and an opening therethrough extending from said upper portion to said lower portion;

a bottom member including an outer shell having a generally horizontal floor portion, a generally vertically extending side portion integral with said floor portion, and a refractory lining affixed to said bottom member shell, said bottom member refractory lining forming a pocket for receiving said treatment alloy;

a ladle carrier connected to said body member and adapted for connection to a hoist to support said treating ladle above the ground, said ladle carrier including a bail carrier adapted for connecting to a hoist for supporting said treating ladle in mid-air and a retaining ring engaged with said body member and connected to said bail carrier; and fastening means for detachably connecting said bottom member to said lower portion of said body member, said body member and said bottom member forming a disassemblable receptacle for the production of ductile iron therewithin.

9. The treating ladle of claim 8 wherein said body member includes stops positioned above said retaining ring and below said retaining ring to prevent said body member from moving relative to said retaining ring.

10. The treating ladle of claim 9 wherein said retaining ring includes first and second semi-circular members and connecting means for detachably connecting said first and second members to form a generally circular retaining ring, said retaining ring being disengageable from said treating ladle by disconnecting said first and second semi-circular members.

11. The treating ladle of claim 10 wherein said retaining ring is pivotally connected to said bail carrier to pivotally support said treating ladle relative to said bail carrier and permit a tipping of said treating ladle to empty the contents from therewithin, said ladle carrier further including a position control means to control the pivotal movement of said treating ladle relative to said bail carrier.

12. The treating ladle of claim 11 wherein said fastening means includes a first set of connecting tabs affixed to said lower portion of said body member in a spaced relationship around the perimeter of said body member, a second set of connecting tabs affixed to said side portion of said bottom member in spaced relationship around the perimeter of said bottom member, each connecting tab of said first set being alignable with a corresponding connecting tab of said second set, and a fastener for connecting each corresponding pair of connecting tabs to detachably affix said bottom member to said body member.

13. The treating ladle of claim 12 wherein said side portion of said bottom member extends vertically from said floor portion a distance at least as high as said pocket, said bottom member completely encompassing said pocket, the joint between said body member and said bottom member being sealable with refractory paste.

14. The treating ladle of claim 8 wherein said bottom member refractory lining forms a pair of semi-circular pockets with a refractory dam extending therebetween.

* * * * *